US010619903B2

(12) United States Patent
Schuster et al.

(10) Patent No.: US 10,619,903 B2
(45) Date of Patent: Apr. 14, 2020

(54) DISCHARGE PRESSURE CALCULATION FROM TORQUE IN AN HVAC SYSTEM

(71) Applicant: Carrier Corporation, Jupiter, FL (US)

(72) Inventors: Don A. Schuster, Lindale, TX (US); Adeyemi A. Adepetu, Jamaica Plain, MA (US); Rajendra K. Shah, Indianapolis, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 144 days.

(21) Appl. No.: 15/834,494

(22) Filed: Dec. 7, 2017

(65) Prior Publication Data

US 2018/0100680 A1 Apr. 12, 2018

Related U.S. Application Data

(62) Division of application No. 14/368,941, filed as application No. PCT/US2012/071145 on Dec. 21, 2012, now Pat. No. 9,885,508.

(60) Provisional application No. 61/580,683, filed on Dec. 28, 2011.

(51) Int. Cl.
*F25B 49/02* (2006.01)

(52) U.S. Cl.
CPC ..... *F25B 49/022* (2013.01); *F25B 49/02* (2013.01); *F25B 2500/19* (2013.01); *F25B 2500/23* (2013.01); *F25B 2500/24* (2013.01); *F25B 2700/04* (2013.01); *F25B 2700/15* (2013.01); *F25B 2700/171* (2013.01); *F25B 2700/1931* (2013.01); *F25B 2700/1933* (2013.01); *F25B 2700/21163* (2013.01)

(58) Field of Classification Search
CPC combination set(s) only.
See application file for complete search history.

(56) References Cited

U.S. PATENT DOCUMENTS 3,650,121 A 3/1972 Kimpel
5,150,581 A 9/1992 Smith
5,214,918 A * 6/1993 Oguni ..... F25B 13/00 62/126
5,306,116 A 4/1994 Gunn et al.
5,651,264 A 7/1997 Lo et al.
(Continued)

FOREIGN PATENT DOCUMENTS

EP 1489370 A1 12/2004
EP 1630418 A1 8/2005
(Continued)

OTHER PUBLICATIONS

International Preliminary Report on Patentability for application PCT/US2012/071145, dated Jul. 1, 2014, 7 pages.
(Continued)

*Primary Examiner* — Henry T Crenshaw
(74) *Attorney, Agent, or Firm* — Cantor Colburn LLP

(57) ABSTRACT

A method for determining system subcooling in a vapor compression system including a compressor, a condenser, an expansion device and an evaporator operatively connected in a serial relationship in a refrigerant flow circuit, the method including receiving information indicative of a compressor torque or compressor current; and determining a degree of system subcooling in response to the receiving of the information.

7 Claims, 2 Drawing Sheets

(56) References Cited

U.S. PATENT DOCUMENTS

| | | | | |
|---|---|---|---|---|
| 5,907,957 | A | 6/1999 | Lee et al. | |
| 5,959,429 | A | 9/1999 | Tajima | |
| 6,098,412 | A | 8/2000 | Porter et al. | |
| 6,210,130 | B1 | 4/2001 | Kakuda | |
| 6,321,543 | B1 * | 11/2001 | Said | F25B 49/022 62/156 |
| 6,393,849 | B1 | 5/2002 | Takenaka et al. | |
| 6,484,520 | B2 | 11/2002 | Kawaguchi et al. | |
| 6,793,455 | B2 | 9/2004 | Prasad et al. | |
| 6,890,673 | B2 | 5/2005 | Higashiyama et al. | |
| 7,210,895 | B2 | 5/2007 | Kotani et al. | |
| 7,389,648 | B2 | 6/2008 | Concha et al. | |
| 7,676,331 | B2 | 3/2010 | Sawada et al. | |
| 7,721,563 | B2 | 5/2010 | Takahashi et al. | |
| 7,841,197 | B2 | 11/2010 | Noda | |
| 7,905,702 | B2 | 3/2011 | Stabley et al. | |
| 2003/0215336 | A1 | 11/2003 | Hattori | |
| 2004/0020227 | A1 | 2/2004 | Takemoto | |
| 2005/0086960 | A1 | 4/2005 | Yokozeki | |
| 2006/0075771 | A1 * | 4/2006 | Tracey, Jr. | F25B 49/005 62/506 |
| 2006/0080976 | A1 | 4/2006 | Markowitz et al. | |
| 2006/0137366 | A1 * | 6/2006 | Kang | F25B 45/00 62/149 |
| 2008/0053114 | A1 | 3/2008 | Zhao | |
| 2008/0168785 | A1 | 7/2008 | Sauer | |
| 2008/0209925 | A1 | 9/2008 | Pham | |
| 2009/0041598 | A1 * | 2/2009 | Saito | F04C 18/0215 417/410.1 |
| 2009/0071175 | A1 * | 3/2009 | Pham | F25B 49/005 62/129 |
| 2009/0090113 | A1 * | 4/2009 | Caillat | F04B 39/06 62/56 |
| 2009/0260375 | A1 | 10/2009 | Miyazaki et al. | |
| 2010/0263391 | A1 | 10/2010 | Tetu et al. | |
| 2011/0041533 | A1 | 2/2011 | Foye et al. | |
| 2015/0027138 | A1 | 1/2015 | Schuster | |
| 2016/0290671 | A1 | 10/2016 | Schuster | |

FOREIGN PATENT DOCUMENTS

| | | | |
|---|---|---|---|
| EP | 1978254 | A1 | 10/2008 |
| EP | 2129921 | B1 | 12/2011 |
| GB | 2474696 | A | 4/2011 |
| JP | 2004175290 | A | 6/2004 |
| JP | 2009036130 | A | 2/2009 |
| JP | 2010002090 | A | 1/2010 |
| WO | 2009038624 | A1 | 3/2009 |
| WO | 2009120654 | A1 | 10/2009 |
| WO | 2010036614 | A2 | 4/2010 |
| WO | 2010141815 | A2 | 12/2010 |

OTHER PUBLICATIONS

International Search Report for application PCT/US2012/071145, dated Jun. 6, 2013, 7 pages.

Written Opinion for application PCT/US2012/071145, dated Jun. 6, 2013, 6 pages.

* cited by examiner

DISCHARGE PRESSURE CALCULATION FROM TORQUE IN AN HVAC SYSTEM

CROSS-REFERENCE TO RELATED APPLICATION

This application is a divisional of U.S. patent application Ser. No. 14/368,941, filed Jun. 26, 2014, which is a National Stage application of International patent application number PCT/US2012/071145, filed Dec. 21, 2012, which claims the benefit of U.S. provisional patent application Ser. No. 61/580,683, filed Dec. 28, 2011, the contents of each prior application being incorporated by reference herein in its entirety.

FIELD OF INVENTION

This invention relates generally to refrigerant vapor compression systems for residential or light commercial heating and refrigeration applications and, more particularly, to a method and system for determining the discharge pressure by utilizing system parameters and a torque-to-discharge pressure map during operation of the vapor compression system.

DESCRIPTION OF RELATED ART

Maintaining proper refrigerant charge level is essential to the safe and efficient operation of an air conditioning system. Improper charge level, either in deficit or in excess, can cause a reduced system energy efficiency and premature compressor failure in some cases. An over-charge in the system results in compressor flooding, which, in turn, may be damaging to the motor and mechanical components. Inadequate refrigerant charge can lead to reduced system capacity, thus reducing system efficiency. Low charge also causes an increase in refrigerant temperature entering the compressor, which may cause thermal over-load of the compressor. Thermal over-load of the compressor can cause degradation of the motor winding insulation, thereby bringing about premature motor failure. Thermal over-load may also cause overheating and damage the pumping elements.

Charge adequacy has traditionally been checked manually by trained service technicians using pressure gauges, temperature measurements, and a pressure to refrigerant temperature relationship chart for the particular refrigerant resident in the system. For refrigerant vapor compression systems which use a thermal expansion valve (TXV), or an electronic expansion valve (EXV), the expansion valve component regulates the superheat of the refrigerant leaving the evaporator at a fixed value, while the amount of subcooling of the refrigerant exiting the condenser varies depending on the total system refrigerant charge (i.e. charge level). Consequently, in such systems, the "subcooling method" is customarily used as an indicator for charge level. In this method, the amount of subcooling, defined as the saturated refrigerant temperature at the refrigerant pressure at the outlet of the condenser coil for the refrigerant in use, also called the refrigerant condensing temperature, minus the actual refrigerant temperature measured at the outlet of the condenser coil, is determined and compared to a range of acceptance levels of subcooling. For example, a subcool temperature range between 10 and 15 degree Fahrenheit is generally regarded as acceptable in a refrigerant vapor compression system operating as a residential or light commercial air conditioner.

In general during the charging process, the technician measures the refrigerant pressure at the condenser outlet and the refrigerant line temperature at a point downstream with respect to refrigerant flow of the condenser coil and upstream with respect to refrigerant flow of the expansion valve, generally at the outlet of the condenser. With these refrigerant pressure and temperature measurements, the technician then refers to the pressure to temperature relationship chart for the refrigerant in use to determine the saturated refrigerant temperature at the measured pressure and calculates the amount of subcooling actually present at the current operating conditions, which is outdoor temperature, indoor temperature, humidity, indoor airflow and the like. If the measured amount of subcooling lies within the range of acceptable levels, the technician considers the system properly charged. If not, the technician will adjust the refrigerant charge by either adding a quantity of refrigerant to the system or removing a quantity of refrigerant from the system, as appropriate.

As operating conditions may vary widely from day to day, the particular amount of subcooling measured by the field service technician at any given time may not truly reflect the amount of subcooling present during "normal" operation of the system. As a result, this charging procedure is also an empirical, time-consuming, and a trial-and-error process subject to human error. Therefore, the technician may charge the system with an amount of refrigerant that is not the optimal amount charge for "normal" operating conditions, but rather with an amount of refrigerant that is merely within an acceptable tolerance of the optimal amount of charge under the operating conditions at the time the system is charged.

BRIEF SUMMARY

According to one aspect of the invention, a method for determining discharge pressure for a compressor operatively connected to a condenser, an expansion device, and an evaporator in a serial relationship, includes receiving information indicative of a compressor torque or compressor current; and determining a discharge pressure in response to the receiving of the information.

According to another aspect of the invention, a discharge pressure determination system for a compressor, includes a vapor compression system including a compressor, a condenser, an expansion device and an evaporator operatively connected in a serial relationship in a refrigerant flow circuit; and a control unit configured for receiving information indicative of a compressor torque or compressor current and for determining the discharge pressure as a function of the received information.

According to another aspect of the invention, a method for determining system subcooling in a vapor compression system including a compressor, a condenser, an expansion device and an evaporator operatively connected in a serial relationship in a refrigerant flow circuit, includes receiving information indicative of a compressor torque or compressor current; and determining a degree of system subcooling in response to the receiving of the information.

Other aspects, features, and techniques of the invention will become more apparent from the following description taken in conjunction with the drawings.

BRIEF DESCRIPTION OF THE SEVERAL VIEWS OF THE DRAWINGS

Referring now to the drawings wherein like elements are numbered alike in the FIGURES.

DETAILED DESCRIPTION

Embodiments of an HVAC system include a vapor compression-type HVAC system that utilizes information obtained from a controller, in order to estimate the compressor torque and predict the discharge pressure for the compressor. Compressor torque may be obtained in more than one way. With inverter driven compressors, compressor torque may be a direct output of the inverter such as, for example, by modulating the frequency of the electrical power delivered to a motor driving the inverter driven compressor, thereby controlling the torque applied by the motor on the inverter driven compressor. In single speed compressors using an AC or permanent split capacitor (PSC) motors, the torque may be obtained indirectly from the voltage differential, current, and phase-angle differential of the motor windings and used to infer the compressor torque. In one non-limiting example, the current is mapped to a compressor torque. From the compressor torque, a discharge pressure is calculated. Also, the calculated discharge pressure may be used, in an exemplary embodiment, to calculate the degrees of subcooling based on at least the discharge pressure.

The use of additional known system data such as suction pressure and compressor speed (in inverter driven or variable speed compressors) can enhance the accuracy of the discharge pressure prediction. The discharge pressure calculation is one of two or more variables utilized to facilitate the charging of the system in a "self-charging" mode and to periodically monitor the refrigerant charge in the system in a "charge monitoring" mode. In the vapor compression-type HVAC system, the torque driving the compressor is also related to the compressor motor current. Therefore, the discharge temperature determination methods described herein can use either the compressor torque or the compressor motor current in an equivalent matter.

Figure 1:
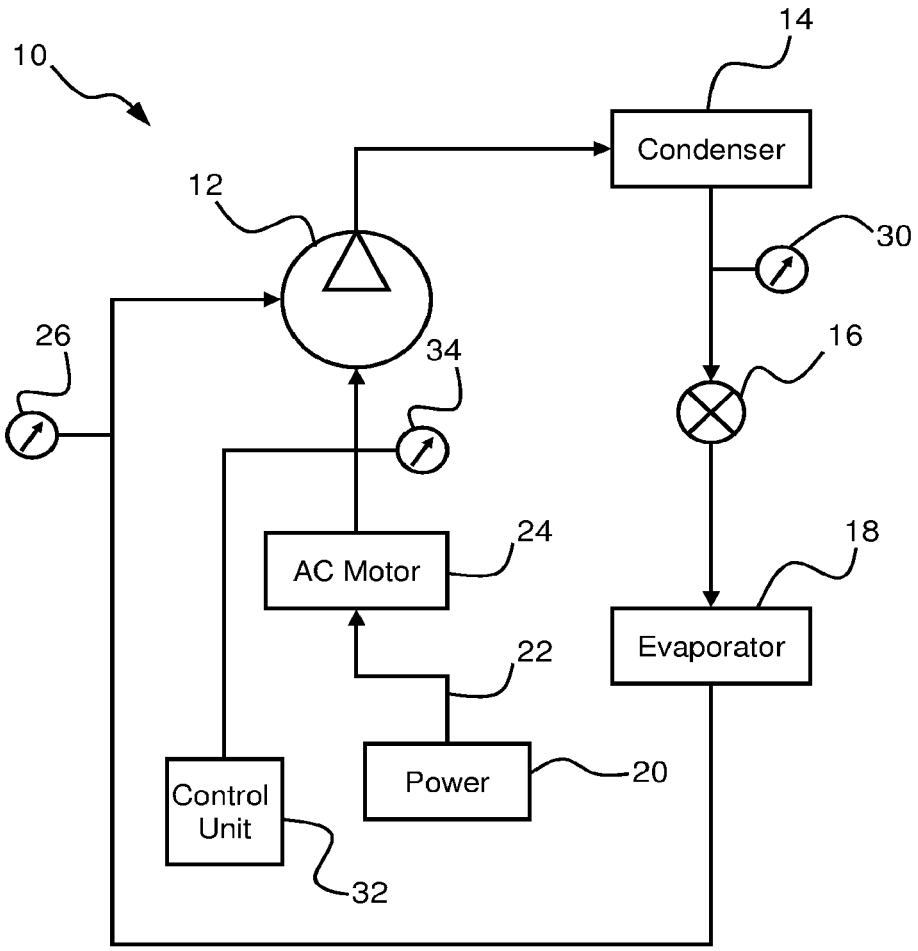
FIG. 1 illustrates a schematic view of a refrigerant vapor compression system according to an embodiment of the invention.

Referring now to the drawings, FIG. 1 illustrates an exemplary refrigerant vapor compression system 10 having a compressor 12 integrated with a single speed non-inverter type motor 24 such as, for example, an AC motor or a permanent split capacitor (PSC) motor, and operably connected to a control unit 32 according to an embodiment of the invention. Particularly, refrigerant vapor from compressor 12 is delivered to a condenser 14 where the refrigerant vapor is liquefied at high pressure, thereby rejecting heat to the outside air (e.g., via a condenser fan). The liquid refrigerant exiting condenser 14 is delivered to an evaporator 18 through an expansion valve 16. In embodiments, the expansion valve 16 may be a thermostatic expansion valve or an electronic expansion valve for controlling superheat of the refrigerant. The refrigerant passes through the expansion valve 16 where a pressure drop causes the high-pressure liquid refrigerant to achieve a lower pressure combination of liquid and vapor. As the indoor air passes across evaporator 18 (e.g., via an evaporator fan), the low-pressure liquid refrigerant evaporates, absorbing heat from the indoor air, thereby cooling the air and evaporating the refrigerant. The low-pressure refrigerant is again delivered to compressor 12 where it is compressed to a high-pressure, high temperature gas, and delivered to condenser 14 to start the refrigeration cycle again. It is to be appreciated that while a specific refrigeration system is shown in FIG. 1, the present teachings are applicable to any refrigeration system, including a heat pump, HVAC, and chiller systems. In a heat pump, during cooling mode, the process is identical to that as described hereinabove. In the heating mode, the cycle is reversed with the condenser and evaporator of the cooling mode acting as an evaporator and condenser, respectively.

Also shown in FIG. 1, system 10 includes a compressor 12, which receives alternating current (AC) electrical power (for example, electrical power is a single-phase AC line power at 230V/60 Hz) from a power supply 20 on line 22. In an embodiment, the compressor 12 is integrated with the single-speed motor 24 that provides the mechanical power necessary to drive a crankshaft (not shown) in the compressor 12 although, in another embodiment, the single-speed motor 24 may be a stand-alone induction motor for driving the crankshaft of the compressor 12. Also, system 10 includes a control unit 32 operably connected to the compressor 12 and having a preprogrammed microprocessor for executing instructions stored in a computer readable medium. The control unit 32 executes algorithms for predicting the discharge pressure for the compressor 12 from information received about current and voltage differential. In an embodiment, the control unit 32 stores data related to current and voltage differential in the motor or compressor 12, which is utilized to map to a compressor torque, which provides a differential pressure $P_{Differential}$ across the compressor 12. In an embodiment, the current, phase-angle differential and voltage differential for the start (or secondary) and run (or primary) windings of the compressor motor (not shown) are stored in a memory device in control unit 32 and used to infer a compressor torque. In another embodiment, other types of motors may be utilized in system 10 and currents obtained may be used to infer compressor torque for the compressor 12. The memory device may be a ROM, an EPROM or other suitable data storage device. Specifically, the current, phase-angle and voltage differentials between the start and run windings are mapped to a compressor torque, and subsequently to a pressure differential to estimate the discharge pressure $P_{Discharge}$.

In an exemplary embodiment, the control unit 32 receives information regarding the suction pressure $P_{Suction}$ via a signal received by pressure sensor 26, which corresponds to a refrigerant pressure entering the suction port of the compressor 12, which is used to enhance the estimation of discharge pressure $P_{Discharge}$ and to determine the system subcooling using refrigerant liquid line temperature shown below. In another exemplary embodiment, the compressor torque may be obtained from a torque transducer 34, which is subsequently mapped to the discharge pressure of compressor 12 via an algorithm in control unit 32. In an embodiment, the control unit 32 executes algorithms for calculating the discharge pressure $P_{Discharge}$ of compressor 12 by mapping compressor torque to discharge pressure utilizing the suction pressure for the refrigerant being used. It is to be appreciated that the discharge pressure may be estimated from the compressor torque without utilizing a pressure sensor to directly provide a refrigerant pressure at the high side of the compressor 12, thereby providing for a more cost-efficient HVAC system 10.

Also shown in FIG. 1, system 100 includes a temperature sensor 30 that is connected with the refrigerant circuit to measure the refrigerant liquid line temperature, $T_{Liquid}$, downstream with respect to refrigerant flow of the outlet of the condenser coil 14 and upstream with respect to refrigerant flow of the expansion valve 16. In one example, the temperature sensor 30 may be a conventional temperature sensor, such as for example a thermocouple, thermistor, or similar device that is mounted on the refrigerant line through which the refrigerant is circulating. It is to be appreciated that the temperature sensor 30 operates to provide the refrigerant liquid line temperature $T_{Liquid}$ and may also have dual usage as the defrost temperature for controlling the defrosting of the evaporator coil 14, thereby eliminating an additional sensor needed for defrosting function for the evaporator coil 14. In an embodiment, the control unit 32 calculates the discharge pressure $P_{Discharge}$ using equation (1) and stores this value in the memory device on control unit 32.

$$P_{Discharge}=a*P_{Suction}+b*\text{compressor speed}+c*(\text{compressor torque})+d*(\text{compressor torque})^2+e*(\text{compressor torque})^3+f*(\text{compressor torque})^4 \quad (1)$$

Where a, b, c, d, e, and f are empirical coefficients.

Additionally, the control unit 32 stores, in a memory device, received signals from sensors 26, 30 as well as data related to compressor torque in estimating compressor discharge pressure $P_{Discharge}$ to calculate the system subcooling. In calculating the system subcooling, the control unit 32 converts the analog signal received from the pressure sensor 26 into a digital signal and stores the resulting digital signal indicative of the respective measured or calculated refrigerant discharge pressure $P_{Discharge}$. Similarly, the control unit 32 converts the analog signal received from the temperature sensor 30 into a digital signal and stores that digital signal indicative of the measured refrigerant liquid line temperature $T_{Liquid}$. In operation, the control unit 32 is programmed to calculate the saturated discharge temperature $T_{Dsat}$ from the discharge pressure $P_{Discharge}$ by mapping values of $P_{Discharge}$ to $T_{Dsat}$. Additionally, the control unit 32 stores, in a memory device, received signals from sensors 26, 30 as well as data related to compressor torque in estimating compressor discharge pressure $P_{Discharge}$ to calculate the system subcooling. In calculating the system subcooling, the control unit 32 converts the analog signal received from the pressure sensor 26 into a digital signal and stores the resulting digital signal indicative of the respective measured or calculated refrigerant discharge pressure $P_{Discharge}$. Similarly, the control unit 32 converts the analog signal received from the temperature sensor 30 into a digital signal and stores that digital signal indicative of the measured refrigerant liquid line temperature $T_{Liquid}$. The control unit 32 uses the saturated discharge temperature $T_{Discharge}$ and the liquid line temperature $T_{Liquid}$ to calculate the actual degrees of system subcooling. Also, the control unit 32 processes the signals received from sensor 30 indicative of the refrigerant liquid line temperature $T_{Liquid}$, and utilizes the $T_{Dsat}$ to $P_{Discharge}$ map to store $T_{Dsat}$ and $T_{Liquid}$ in the memory device on control unit 32. The control unit 32 is preprogrammed with the pressure to temperature relationship charts characteristic of at least the refrigerant in use in the system 10. Knowing the saturated discharge temperature $T_{Dsat}$, the control unit 32 calculates the actual degrees of system subcooling SSC using the following equation (2) and stores the actual degrees of subcooling in the memory unit.

$$SSC=T_{Dsat}-T_{Liquid} \quad (2)$$

Figure 2:
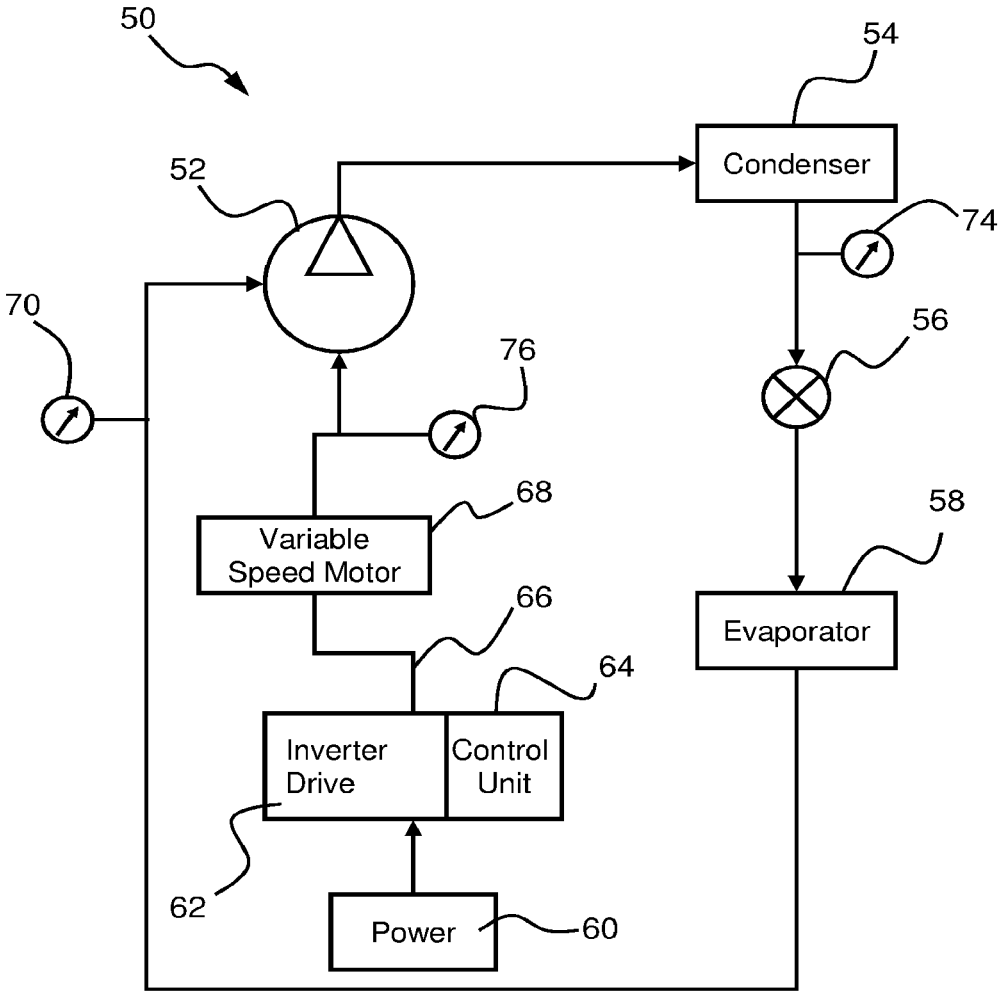
FIG. 2 illustrates a schematic view of an air-conditioning system having an inverter-driven variable speed compressor according to an embodiment of the invention.

FIG. 2 illustrates a refrigerant vapor compression system 50 having a variable speed compressor 52 driven by a variable speed motor 68 according to an embodiment of the invention. The system 50 is substantially similar to the embodiment shown and described in FIG. 1, and includes refrigerant vapor from compressor 52 that is delivered to a condenser 54 where the refrigerant vapor is liquefied at high pressure, thereby rejecting heat to the outside air. The liquid refrigerant exiting condenser 54 is delivered to an evaporator 58 through an expansion valve 56. In embodiments, the expansion valve 56 may be a thermostatic expansion valve or an electronic expansion valve for controlling super heat of the refrigerant. The refrigerant passes through the expansion valve 56 where a pressure drop causes the high-pressure liquid refrigerant to achieve a lower pressure combination of liquid and vapor. As the indoor air passes across evaporator 58, the low-pressure liquid refrigerant absorbs heat from the indoor air, thereby cooling the air and evaporating the refrigerant. The low-pressure refrigerant is again delivered to compressor 52 where it is compressed to a high-pressure, high temperature gas, and delivered to condenser 54 to start the refrigeration cycle again. It is to be appreciated that while a specific refrigeration system is shown, the present teachings are applicable to any heating or cooling system, including a heat pump, HVAC, and chiller systems. In a heat pump, during cooling mode, the process is identical to that as described hereinabove, while in the heating mode, the cycle is reversed with the condenser and evaporator of the cooling mode acting as an evaporator and condenser, respectively.

As shown, system 50 includes a compressor 52 driven by an inverter drive 62. In embodiments, the inverter drive 62 may be a variable frequency drive (VFD) or a brushless DC motor (BLDC) drive. Particularly, inverter drive 62 is operably coupled to compressor 52, and receives an alternating current (AC) electrical power (for example, electrical power is a single-phase AC line power at 230V/60 Hz) from a power supply 60 and outputs electrical power on line 66 to a variable speed motor 68. The variable speed motor 68 provides mechanical power to drive a crankshaft of the compressor 62. In an embodiment, the variable speed motor 68 may be integrated inside the exterior shell of the compressor 62. Inverter drive 62 includes solid-state electronics to modulate the frequency of electrical power on line 66. In an embodiment, inverter drive 62 converts the AC electrical power, received from supply 60, from AC to direct current (DC) using a rectifier, and then converts the electrical power from DC back to a pulse width modulated (PWM) signal, using an inverter, at a desired PWM frequency in order to drive the motor 68 at a motor speed associated with the PWM DC frequency. For example, inverter drive 62 may directly rectify electrical power with a full-wave rectifier bridge, and may then chop the electrical power using insulated gate bipolar transistors (IGBT's) or thyristors to achieve the desired PWM frequency. In embodiments, other suitable electronic components may be used to modulate the frequency of electrical power from power supply 60. Further, control unit 64 includes a processor for executing an algorithm used control the PWM frequency that is delivered on line 66 to the motor 68. By modulating the PWM frequency of the electrical power delivered on line 66 to the electric motor 68, control unit 64 thereby controls the torque applied by motor 68 on compressor 52 there by controlling its speed, and consequently the capacity, of compressor 52.

Also shown, the control unit 64 includes a computer readable medium for storing data in a memory unit related to estimating compressor discharge pressure ($P_{Discharge}$) from compressor and refrigeration system parameters. In embodiments, the control unit 64 stores information related to compressor torque as well as line voltages, compressor motor current, and compressor speed obtained from inverter drive 62. It is to be appreciated that the compressor torque is also related to the compressor motor current and, in embodiments, the discharge temperature determination methods described herein can use either the compressor torque or the compressor motor current in an equivalent matter.

In an exemplary embodiment, the discharge pressure $P_{Discharge}$ may be obtained from the motor torque of a variable speed compressor that is mapped to $P_{Discharge}$. In another embodiment, the control unit 64 receives information regarding the suction pressure $P_{Suction}$ via a signal received by pressure sensor 70, which corresponds to the refrigerant pressure entering the suction port of the compressor 52. $P_{Suction}$ is used to enhance the estimation of discharge pressure $P_{Discharge}$. Control unit 64 includes a processor for executing instructions necessary for performing algorithms for mapping compressor discharge pressure $P_{Discharge}$ from suction pressure $P_{Suction}$, compressor torque, and compressor speed. In another embodiment, the compressor torque may be obtained from a torque transducer 76 that is subsequently used to map to the discharge pressure $P_{Discharge}$ of compressor 52 via an algorithm in control unit 64. In an embodiment, the control unit 64 calculates the discharge pressure $P_{Discharge}$ using equation (3) and stores this value in the memory unit:

$$P_{Discharge}=a*P_{Suction}+b*\text{compressor speed}+c*(\text{compressor torque})+d*(\text{compressor torque})^2+e*(\text{compressor torque})^3+f*(\text{compressor torque})^4 \quad (3)$$

Where a, b, c, d, e, and f are empirical coefficients.

In an embodiment, sensor 74 is operably connected with the refrigerant circuit to measure the refrigerant liquid temperature, $T_{Liquid}$, downstream with respect to refrigerant flow of the outlet of the condenser coil 54 and upstream with respect to refrigerant flow of the expansion valve 56. It is to be appreciated that the temperature sensor 74 may be a conventional temperature sensor, such as for example a thermocouple, thermistor, or similar device that is mounted on the refrigerant line through which the refrigerant is circulating. It is to be appreciated that the temperature sensor 74 also operates to provide the defrost temperature for controlling the defrosting of the evaporator coil 58.

Additionally, the control unit 64 stores, in a memory device, received signals from sensors 70, 74 as well as data related to compressor torque in estimating compressor discharge pressure $P_{Discharge}$ to calculate the system subcooling. In calculating the system subcooling, the control unit 64 converts the analog signal received from the pressure sensor 70 into a digital signal and stores the resulting digital signal indicative of the respective measured or calculated refrigerant discharge pressure $P_{Discharge}$. Similarly, the control unit 64 converts the analog signal received from the temperature sensor 74 into a digital signal and stores that digital signal indicative of the measured refrigerant liquid temperature $T_{Liquid}$. In operation, the control unit 64 is programmed to calculate the saturated discharge temperature $T_{Dsat}$ from the discharge pressure $P_{Discharge}$ by mapping values of $P_{Discharge}$ to $T_{Dsat}$. Additionally, the control unit 64 stores, in a memory device, received signals from sensors 70, 74 as well as data related to compressor torque in estimating compressor discharge pressure $P_{Discharge}$ to calculate the system subcooling. In calculating the system subcooling, the control unit 64 converts the analog signal received from the pressure sensor 70 into a digital signal and stores the resulting digital signal indicative of the respective measured or calculated refrigerant discharge pressure $P_{Discharge}$. Similarly, the control unit 64 converts the analog signal received from the temperature sensor 74 into a digital signal and stores that digital signal indicative of the measured refrigerant liquid temperature $T_{Liquid}$. The control unit 64 uses the saturated discharge temperature $T_{Dsat}$ and the liquid line temperature $T_{Liquid}$ to calculate the actual degrees of system subcooling. Also, the control unit 64 processes the signals received from sensor 74 indicative of the refrigerant liquid temperature $T_{Liquid}$, and the calculated saturated discharge temperature $T_{Dsat}$ and stores the processed data in the memory device on control unit 64. The memory device may be a ROM, an EPROM or other suitable data storage device. The control unit 64 is preprogrammed with the pressure to temperature relationship charts characteristic of at least the refrigerant in use in the system 50. Knowing the saturated discharge temperature $T_{Dsat}$, the control unit 64 calculates the actual degrees of system subcooling SSC using the following equation (4) and stores the actual degrees of subcooling in the memory unit.

$$\text{SSC}=T_{Dsat}-T_{Liquid} \quad (4)$$

The technical effects and benefits of embodiments relate to an HVAC having an inverter driven variable speed compressor that utilizes information from the inverter related to the compressor torque, compressor speed, and suction pressure in order to estimate the discharge pressure of a compressor without utilizing a pressure sensor for measuring the high side discharge pressure of the compressor.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while various embodiment of the invention have been described, it is to be understood that aspects of the invention may include only some of the described embodiments. Accordingly, the invention is not to be seen as limited by the foregoing description, but is only limited by the scope of the appended claims.

What is claimed is:

1. A method for determining system subcooling in a vapor compression system including a compressor, a condenser, an expansion device and an evaporator operatively connected in a serial relationship in a refrigerant flow circuit, the method comprising:

receiving information indicative of a compressor torque or compressor current;

determining a discharge pressure as a function of the received information;

mapping the discharge pressure to a saturated discharge temperature;

receiving a sensor signal corresponding to a refrigerant liquid line temperature;

determining a degree of system subcooling as a difference between the saturated discharge temperature and the refrigerant liquid line temperature.

2. The method of claim 1, wherein the received information comprises electric power data including data regarding at least one of a voltage differential, a current, and a phase-angle differential of a motor coupled to the compressor.

3. The method of claim 1, further comprising modulating electric power delivered to a variable speed motor coupled to the compressor.

4. The method of claim 1, further comprising receiving a suction pressure of the compressor.

5. The method of claim 4, further comprising determining the discharge pressure as a function of the received information and the suction pressure.

6. The method of claim 1, further comprising receiving a compressor signal corresponding to a compressor speed of the compressor.

7. The method of claim 6, further comprising determining the discharge pressure as a function of the received information and the compressor speed.

* * * * *